US006830003B2

(12) United States Patent
Treadwell

(10) Patent No.: US 6,830,003 B2
(45) Date of Patent: Dec. 14, 2004

(54) MULTIHULL BOAT

(76) Inventor: Gray Cooper Treadwell, P.O. Box 11500, Auckland (NZ)

( * ) Notice: Subject to any disclaimer, the term of this patent is extended or adjusted under 35 U.S.C. 154(b) by 0 days.

(21) Appl. No.: 10/416,152

(22) PCT Filed: Nov. 14, 2001

(86) PCT No.: PCT/NZ01/00255

§ 371 (c)(1),
(2), (4) Date: May 14, 2003

(87) PCT Pub. No.: WO02/40340

PCT Pub. Date: May 23, 2002

(65) Prior Publication Data

US 2004/0025769 A1 Feb. 12, 2004

(30) Foreign Application Priority Data

Nov. 14, 2000 (NZ) ..... 508188
Dec. 8, 2000 (NZ) ..... 508742

(51) Int. Cl.[7] ..... B63B 1/00
(52) U.S. Cl. ..... 114/61.15; 114/283
(58) Field of Search ..... 114/61.1, 61.11, 114/61.12, 61.14, 61.15, 61.16, 6.18, 61.19, 61.22, 283

(56) References Cited

U.S. PATENT DOCUMENTS 4,421,491 A 12/1983 Pleass

FOREIGN PATENT DOCUMENTS

| | | |
|---|---|---|
| FR | 2451312 | 10/1980 |
| FR | 2503658 | 10/1982 |
| FR | 2768992 | 2/1987 |
| FR | 2607102 | 5/1988 |
| FR | 2619782 | 3/1989 |

OTHER PUBLICATIONS

Derwent Abstract Accession No. 87–270280/38. Feb. 15, 1987.

*Primary Examiner*—Jesus D. Sotelo
(74) *Attorney, Agent, or Firm*—O. M.(Sam) Zaghmout; Bio Intellectual Property Services (BioIPS) LLC

(57) ABSTRACT

The invention relates to an apparatus for attachment to a multihull boat, the apparatus including a beam means substantially transversely associated with at least a first hull and a second hull, the first hull and the second hull being laterally opposed and each hull having a longitundinal axis in the direction of travel of the boat, the beam means being pivotably connected to a first hull or adjacent a first hull to allow for horizontal rotational movement of the first hull, the beam means being pivotalbly connected to a second hull or adjacent a second hull to allow for horizontal rotational movement of the second hull, and wherein the beam means is adapted to allow the first hull and the second hull to pitch independently of the other.

15 Claims, 8 Drawing Sheets

MULTIHULL BOAT

TECHNICAL FIELD

This invention relates to multihull boats and sailing craft. More particularly, but not exclusively, this invention relates to a twin hull boat that is connected by a pivotally mounted beam or beams.

BACKGROUND ART

Although multihull boats, particularly sailing yachts, have many performance advantages over monohull boats, multihull boats can take up significant space in marinas due to the distance between hulls. It can also be difficult to fit a catamaran or trimaran in a marina designed for monohull boats. Further, land transportation of multihull boats can be difficult due to the large width of the boat.

Multihull sailing vessels are known to outperform monohull sailing boats in all but the lightest of conditions. One disadvantage of multihull boats has been the difficulty of righting the vessel after it has been capsized. This can be a disturbing feature in open sea travel when a failure to right a vessel can be potentially fatal.

Modern multihull vessels have become lighter in design due to the use of modern fibre composite materials. Although these materials have many advantages, one disadvantage is that a lighter multihull vessel can be more prone to capsizing than a heavier vessel. This can increase the previously mentioned risk of capsizing in open bodies of water.

It is an object of the present invention to provide a multihull boat which overcomes at least some of the above-mentioned problems, or which provides the public with a useful choice.

SUMMARY OF THE INVENTION

According to a first broad aspect of the invention there is provided an apparatus for attachment to a multihull boat, the apparatus including a beam means substantially transversely associated with at least a first hull and a second hull, the first hull and the second hull being substantially laterally opposed and each hull having a longitudinal axis in the direction of travel of the boat, the beam means being pivotably connected to a first hull or adjacent a first hull to allow for horizontal rotational movement of the first hull, the beam means being pivotably connected to a second hull or adjacent a second hull to allow for horizontal rotational movement of the second hull, and wherein the beam means is adapted to enable the first hull and the second hull to pitch independently of the other.

Preferably the beam means is adapted to enable the hulls to rotate 360 degrees with respect to each other. Desirably the beam means includes a first beam pivotably connected to the first hull and a second beam pivotably connected to the second hull, and a beam joint means positioned between the first hull and the second hull that enables the first beam and the second beam to rotate relative to each other such that the first hull and the second hull pitch independently of the other.

Advantageously the beam joint means includes a releasably attachable securing means retaining the first beam and the second beam in pivotable association and preventing, in use during movement on water, the first hull and the second hull from being drawn together.

When the multihull boat incorporates a sailing hull, preferably the first hull is provided with a mast that is pivotably connected to the hull to allow for vertical rotational movement of the mast, and wherein the beam means is pivotably connected to the mast to enable vertical rotational movement of the beam means.

Desirably the first hull is adapted to form a mast support section, the mast support section being associated with the mast above the pivot connection of the first beam to the mast.

Preferably the mast is tubular and pivotably connected to a cylindrically shaped cavity in the first hull, and wherein a tubular sleeve is fitted between the mast and the cavity and adapted with bearing means to increase the free substantially vertical rotational movement of the mast and the first beam. Desirably the sleeve and the first beam are permanently attached.

Optionally the first beam and the second beam are pivotably connected to a rotational housing located in a suitable position along the beam means to enable the first beam and the second beam to move from a first extended position being substantially transverse to the longitudinal axes of the first hull and the second hull to a second folded position to bring the first hull and the second hull together. Preferably the rotational housing is a bearing housing, and the location of the housing is substantially adjacent a central position between the first hull and the second hull.

Additionally the first hull and the second hull are adapted to interfit in a nesting arrangement when the first hull and the second hull are brought together in the second folded position of the first beam and the second beam.

Desirably the apparatus incorporates hull stabilising means provided between the beam means and the first hull and the second hull, the stabilising means being four flexible stays or rigid struts, or a combination thereof, each said stay or strut being connected at one end to the beam means and the other end being connected to either fore or aft of the first hull or the second hull. Alternatively, the apparatus further includes hull stabilising means provided between the beam means and the first hull and the second hull, the stabilising means being at least two rigid struts, each said strut being connected at one end to the beam means and the other end of at least one strut being connected to either fore or aft of the first hull and at least one strut being connected to either fore or aft of the second strut. Optionally at least two of the stays or struts are releasably attachable to either the first hull or the second hull or the beam means.

According to a second broad aspect of the invention there is provided a self tacking sailing apparatus for use with a jib set on a mast, including a first elongate boom being attached at one end to a suitable first pivot point below the jib and fore of the mast and the other end is associated with the clew of the jib, and a second elongate boom is attached at one end to a suitable second pivot point on the mast and the other end is associated with the clew of the jib and the other end of the first boom.

Preferably the first boom and the second boom are rigid, and wherein the other end of the second boom is pivotably attached to the other end of the first boom, and wherein a rope is attached at one end to the clew of the jib and passes through a slot and pulley in the first boom adjacent the other end of the first boom, and through a guide member positioned at a suitable position along the first boom, the rope then passing through a second guide member positioned at a suitable fixed point below the jib and fore of the mast and aft of the one end of the first boom, the rope is then cleated by a rope retaining means.

Alternatively the first boom and the second boom are rigid, and wherein the one end of the first boom is attached to a sliding member within an elongate sliding means below the jib and fore of the mast and the other end of the first boom is pivotably connected to the other end of the second boom, and the one end of the second boom is attached to a sliding member within an elongate sliding means positioned on the mast.

Preferably the one end of the first boom is associated with an elongate third boom, the third boom extending aft of the main sail and for of the jib and being pivotably attached to a mast and rotatable in a plane substantially perpendicular to the longitudinal axis of the mast. Advantageously the pivotable connections of the beam means to the first hull and the second hull are provided with bearing means. Further, all the pivotable connections may incorporate ring bearings.

According to a third broad aspect there is provided a multihull boat with a first hull and a second hull, the first hull and the second hull being substantially laterally opposed and each hull having a longitudinal axis in the direction of travel of the boat, a beam means being substantially transversely associated with the first hull and a second hull, the beam means being pivotably connected to a first hull or adjacent a first hull to allow for horizontal rotational movement of the first hull, the beam means being pivotably connected to a second hull or adjacent a second hull to allow for horizontal rotational movement of the second hull, and wherein the beam means is adapted to enable the first hull and the second hull to pitch independently of the other.

BRIEF DESCRIPTION OF THE DRAWINGS

Preferred embodiments of the invention will now be illustrated, by way of example only, with reference to the accompanying drawings in which.

DETAILED DESCRIPTION OF THE DRAWINGS

Figure 1:
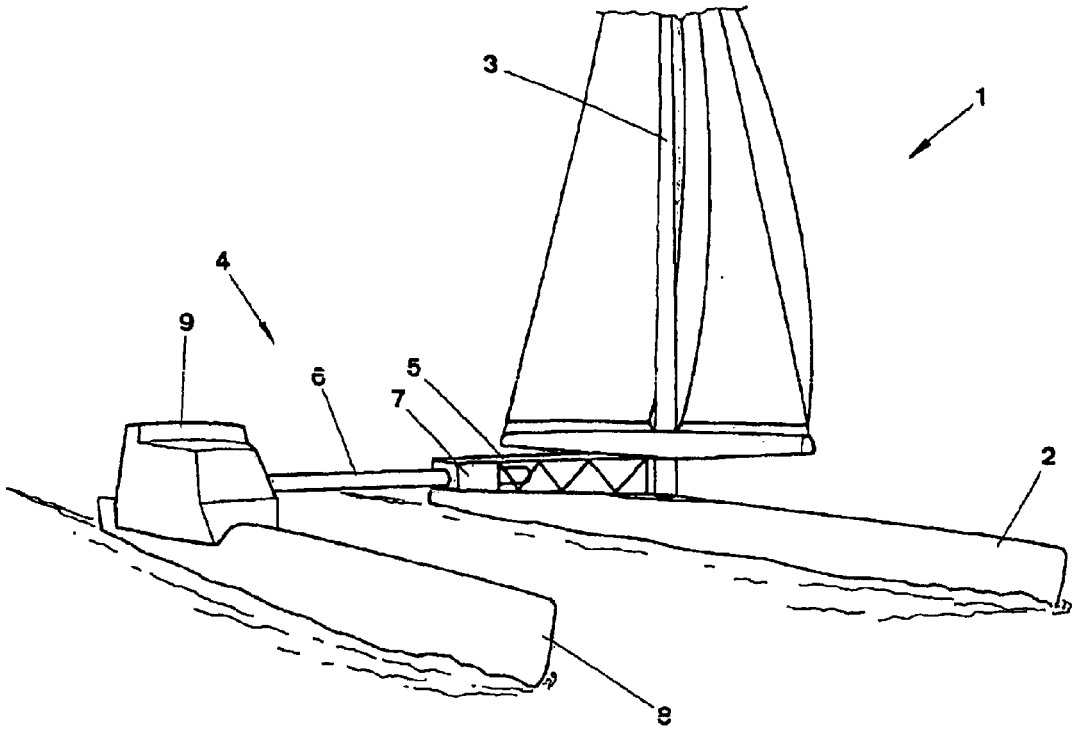
FIG. 1: illustrates a perspective view of a beam means incorporated in a multihull boat in accordance with a preferred embodiment of the invention.
Figure 2:
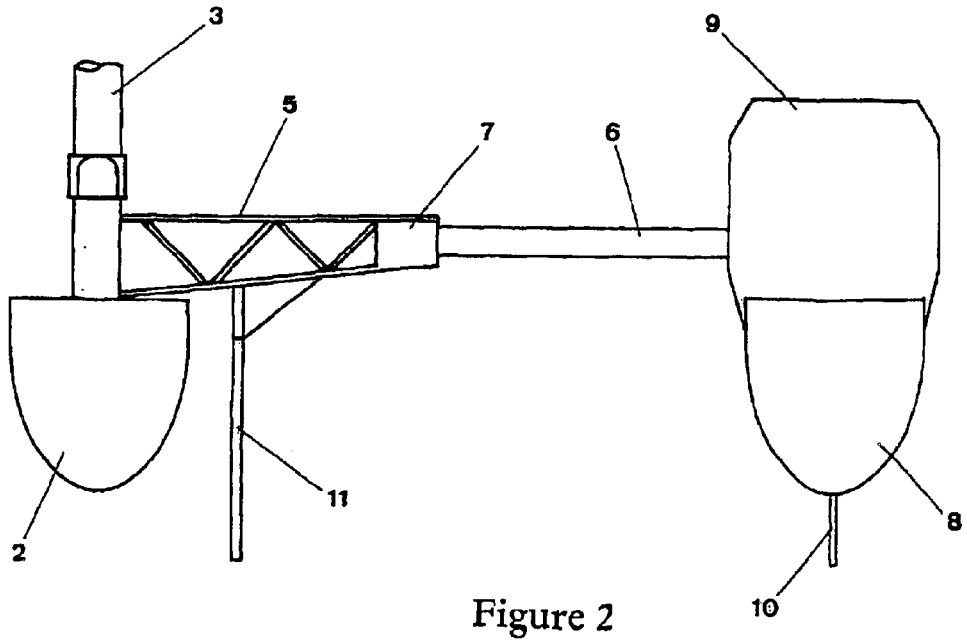
FIG. 2: illustrates a rear view of the multihull boat of FIG. 1.

Referring to FIGS. 1 and 2, a multihull boat, generally described as 1, according to a preferred embodiment of the invention, is illustrated.

The multihull boat 1 includes a first hull 2 preferably having a mast 3 for mounting sails. The mast 3 is desirably pivotally attached to the hull 2. A beam means 4 is preferably mounted to the mast 2 to enable rotational movement of the hull 2 relative to the mast 3. It will be appreciated according to an aspect of the invention that the beam means may be pivotably connected to a cabin or non-hull part mounted to the first hull.

The beam means 4 preferably includes a first beam 5 and a second beam 6 desirably releasably attachable to a centre joint 7. The two beams 5, 6 are made of any suitable and desirable material. Preferably marine materials such as, for example, carbon or glass fibre, stainless steel, kevlar or combinations thereof. Fibre composite materials are preferred in the marine environment as they are non-corrosive and have a high strength to weight ratio.

The other end of the beam means is pivotally mounted to a second hull 8 or pivotably mounted to a structure adjacent the second hull but associated with it. The second hull 8 is preferably in the form of a non-mast hull 8. In this preferred embodiment the second hull includes a cabin 9 where crew or sailors controlling the operation of the vessel or boat 1, more particularly the sails, are located. As seen in FIG. 2, a suitable rudder 10 projects from below the hull 8. The rudder 10 can be suitably thin to reduce water drag and is made of any suitable durable and resilient material. The rudder 10 can be advantageously steerable and in this regard is pivotably mounted to the hull 8 such that the central turning axis is substantially perpendicular to the normal direction of travel of the boat 1 on water, presuming the water is flat. The steerable means of the rudder 10 includes a tiller and tiller extension (not shown) extending between the rudder 10 and the cabin 9. Any known suitable form of rudder 10 control arrangement may be used, such as, alternatively, a rope and pulley system.

A daggerboard 11 is preferably pivotably attachable to the first beam 5 adjacent the mast hull 2. It is envisaged that the use and adjustment of the daggerboard 11 can be controlled by suitable daggerboard adjustment means, including, for example, pulleys and ropes (not shown). It is considered advantageous to arrange the boat 1 with a mast or masts on a first hull 2, and having a rudder 10 attached to the second hull 8.

The boat 1 is seen to desirably have hulls 2, 8 that are pivotally attached to the beam means. In this configuration the hulls 2, 8 are free to pitch rotate independently. It is seen as an advantage that the hulls 2, 8 can rotate 360 degrees relative to each other. This can assist with the righting of either or both of the hulls 2, 8 after a capsize. As the hulls 2, 8 may rotate horizontally relative to the other hull, they may form a "T" shape when the boat 1 has capsized. It is considered that recovery of the boat 1 is assisted by being able to roll each hull, rather than being restricted with standard catamarans and trimarans with having to right the boat by righting the boat end over end or by rotating the whole boat, both methods being more difficult than the method of righting the multihull boat 1 of the present invention.

The rudder 10 is preferably pivotably attached adjacent the stern of the non-mast hull 8, and desirably aft of the centre of gravity and pivot joint of the beam 6 to the hull 8, and adequate buoyancy forward, to enable the rudder 10, in use, to be immersed in water as much as required when the boat 1 is moving. In this configuration wave action and wind force on the mast 3 will not unreasonably reduce control of the boat 1 as in some catamaran and trimaran designs. It is seen therefore that the configuration incorporating a short rudder 10 that only projects into the water a shallow length is desirable for maneuvering or sailing the boat 1 through shallow water.

During sailing, an overloading wind force or wave action can cause loss of control resulting in the boat 1 capsizing. In one possible form of boat capsize if either hull 2, 8 pitch poles, end over end about the pivot points (as described in further detail below) it can leave the other hull upright. This is considered a less catastrophic form of capsize. To right the overturned hull, a mechanism can be configured and arranged to pivot and right the hull, or even both hulls, using the other hull as a working platform.

It is expected that when sailing the boat 1, submerging the bow of the hull 2 from wind force or by wave action may lift the stern of the hull 2, but will not necessarily reduce control of the rudder 10 located adjacent the stern of the hull 8 due to the advantageous feature of the hulls 2, 8 pitching independently.

It will be appreciated that a variety of hull configurations can be arranged incorporating any one or more aspects of the invention. For example, sailors may be located on the mast hull 2 and the hull 8 may not include a cabin but may be an outrigger. In this arrangement the hull 8 may be smaller than is shown in FIG. 1. Alternatively, a third hull may be pivotally attached by a second beam means (not shown) on the port side of the mast hull 2 to form a trimaran.

Figure 3:
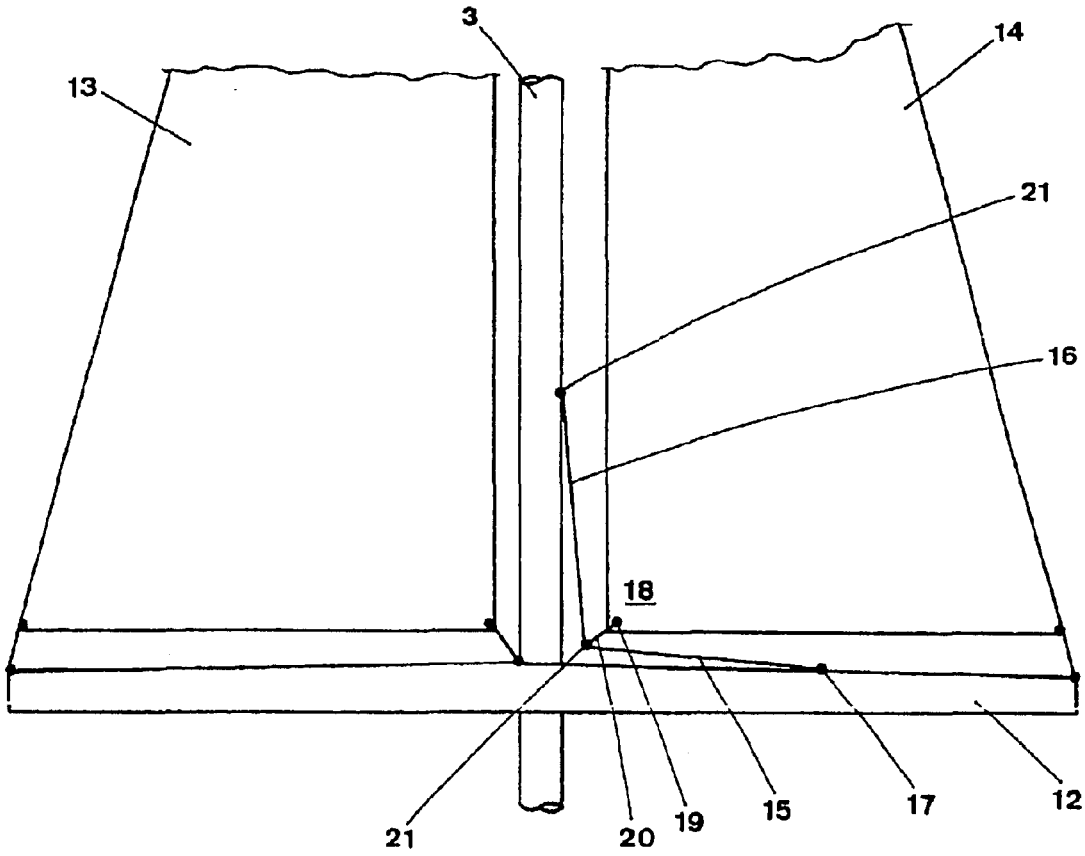
FIG. 3: illustrates a side view of a first sail tacking arrangement for the mast hull.
Figure 4:
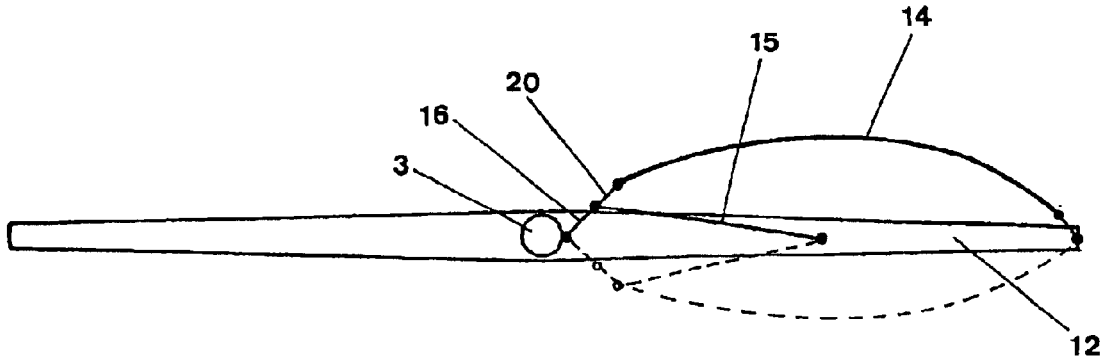
FIG. 4: illustrates a plan view of FIG. 3.

Referring now also to FIGS. 3 and 4, a first sail tacking arrangement on the mast hull 2, according to an aspect of the invention, is illustrated.

In a preferred embodiment with sailors or crew located in the cabin 9 of the hull 8, a suitable arrangement for controlling the sails located on the hull 2, is required.

In the preferred embodiment, a sailing configuration includes a boom 12, desirably in the form of a balestron boom. A mainsail 13 and a jib 14 can be set on the mast 3 and boom 12. The balestron boom 12 can function in a similar manner to an aerorig. The boom 12 pivots about the mast 3. As is known by those skilled in the art, conventional practice is to set the sails at an angle to the wind by the angle of the boat 1, and is trimmed by rigging or levers from the various sails and/or various booms to the hull 2. According to an aspect of the invention, it is desired to allow the sails 13, 14 to be set to the correct angle to the wind, independently of the heading of the hull 2 or boat 1.

The heading of the sails to the wind can be adjusted and maintained manually using conventional rigging adapted to be adjusted and controlled by crew located in the cabin 9 on the hull 8. Alternatively it is envisaged within the scope of the invention to arrange an automated self-steering mechanism for maintaining the heading of the sails to the wind, and may alternatively embody as the adjusting force, a wind vane operated self-steering mechanism as known in the art.

It is seen in the arrangement of FIGS. 3 and 4 that at least two sails are balanced against each other on the boom 12 to collectively maintain an angle of attack to the wind. If that angle is varied, then an adjustment of the sailing arrangement is made either manually or automatically, and the sails move fore or aft relative to the other sails, creating an overbalance in the desired direction until the new angle of attack is achieved. It is considered that the present arrangement dynamically maintains the correct angle of attack of the sails by using the balancing effect of one sail against the other.

Alternative embodiments for using a sailing arrangement in the hull 2 of the boat 1 are envisaged within the scope of the invention. For example, a turntable to rotate the boom, a block and tackle, and a separate boom, with a mainsail and jib on separate masts, can be used.

According to an aspect of the invention a broad self tacking arrangement is described. The self tacking arrangement includes two elongate booms 15, 16. The boom 15 is attached at one end to a suitable pivot point 17 on the boom 12 fore of the mast 3 and the other end is associated with the clew 18 of the foresail or jib 14. A ring 19 is usually associated with the clew 18 of the sail 14 and a link 20 is preferably attached through the ring 19 of the clew 18 to the other end of the boom 15. It is seen that the boom 15 is substantially horizontally disposed.

The boom 16 is attached at one end to a suitable pivot point 21 associated with the mast 3 and the other end is associated with the clew 18 of the foresail or jib 14. Preferably the other end of the boom 16 is attached to a joint 21 with the link 20 and the other end of the boom 15. Desirably the joint 21 has a pivot means to facilitate changes in shape of the jib 14 from a port tack to a starboard tack and vice versa. It is seen that an effect of this self tacking arrangement is to cause the sail 14 to be slack when fully tacked on either a port or starboard tack and the sail 14 is tight when going through the central position when going about between tacks. It is seen that the radius for the arc is tighter than is optimum. However, during many sailing conditions it is considered an advantage to have this self tacking arrangement as the clew 18 of the jib 14 sits aback for the first stage of the tack and then when the hull 2 is fully around, wind pressure will usually invert the jib 14 through onto the next tack.

Figure 5:
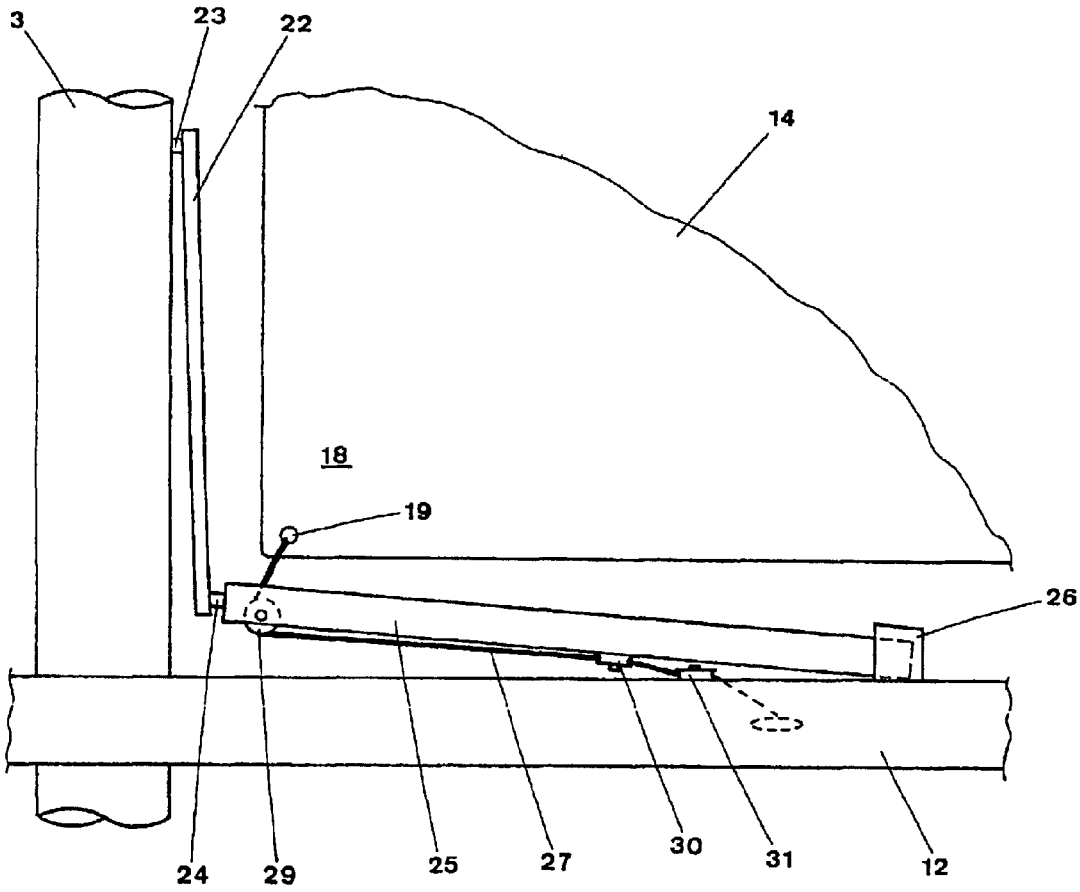
FIG. 5: illustrates a side view of a second sail tacking arrangement for the mast hull.
Figure 6:
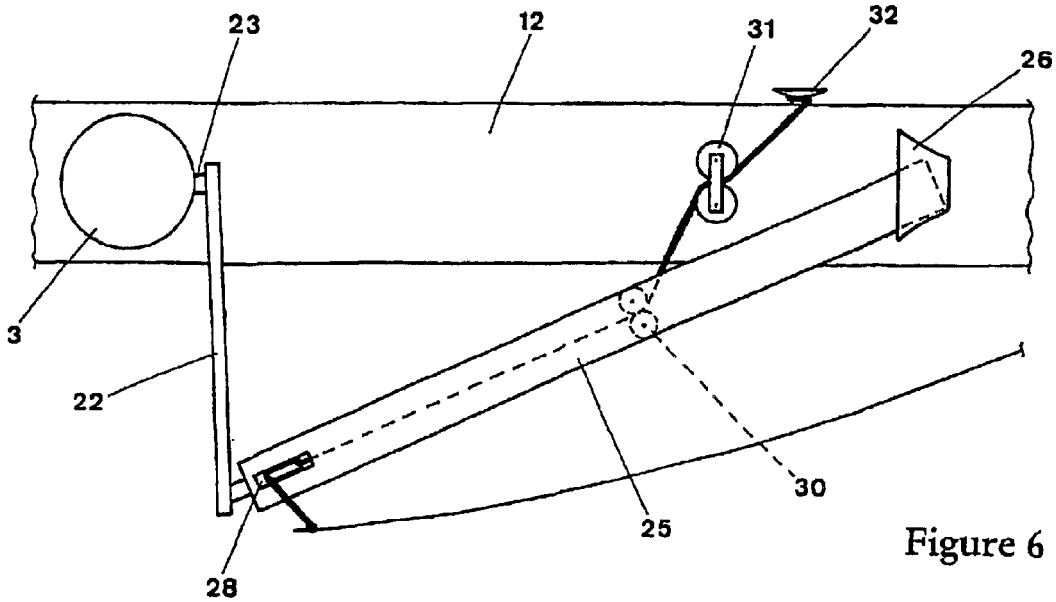
FIG. 6: illustrates a plan view of FIG. 5.

Referring now to FIGS. 5 and 6, a second sail tacking arrangement on the mast hull 2, according to an alternative aspect of the invention, is illustrated.

If the tighter radius as in FIGS. 3 and 4 is not desired, it is envisaged that an alternative arrangement may include a mechanism for adjusting the effective radius of curvature. In this second arrangement a rigid boom 22 is pivotably attached to pivot joint 23 on the mast 3 and pivotably attached by pivot means 24 to a boom 25. The other end of the boom 25 is retained in a boot 26. It is envisaged that the other end of the boom 25 may alternatively be pivotably attached to the main boom 12. Preferably the booms 22, 25 are made of carbon fibre.

A rope or line 27 is attached at one end to the clew 18 through the clew ring 19 and passes through a block in the form of a slot 28 and a pulley 29 arrangement and through a first guide member 30 located along the boom 25 at a suitable point between the clew 18 and the boot 26. The line 27 then passes through a second guide member 31 on the boom 12 at a suitable position between the boot 26 and the mast 3 and then passes through a rope retaining means in the form of a cleat 32 attached to the boom 12 to allow adjustment of the shape of the jib 14 as required. Depending on where the guide members 30, 31 are located along the boom 12, the radius of curvature is adjusted accordingly.

Figure 7:
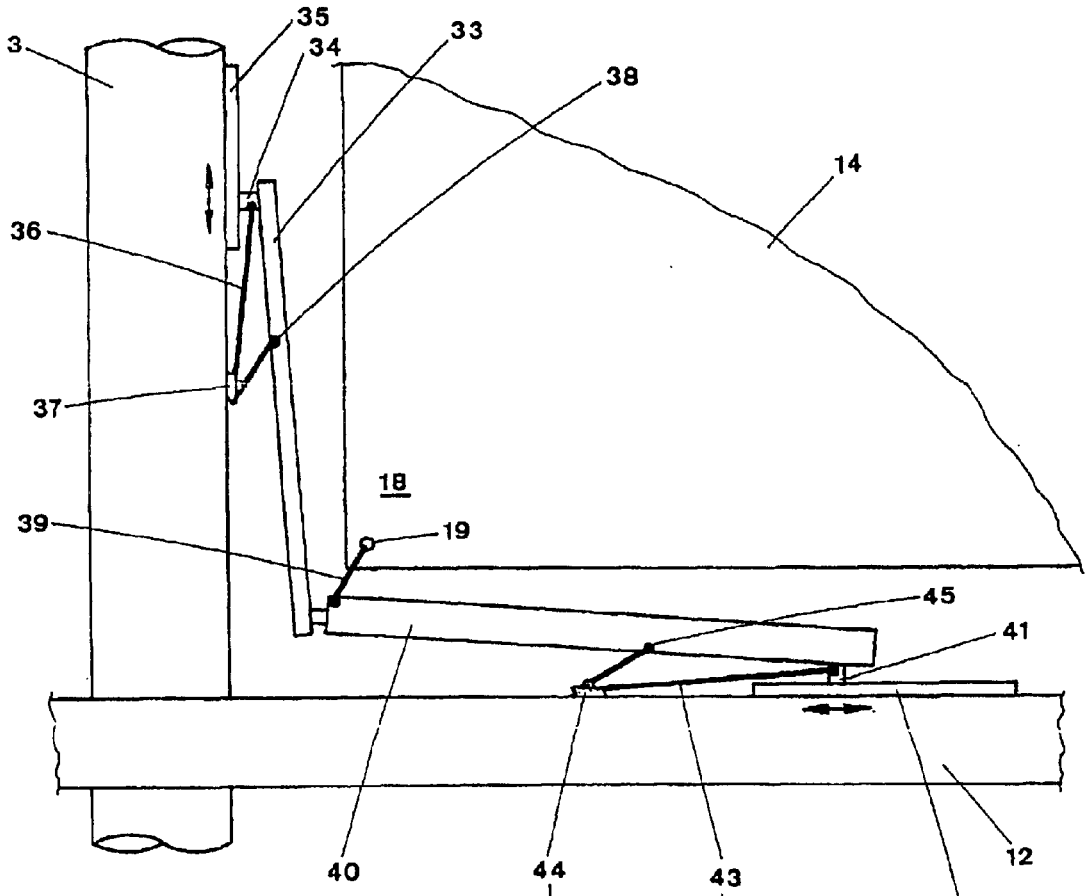
FIG. 7: illustrates a side view of a third sail tacking arrangement for the mast hull.
Figure 8:
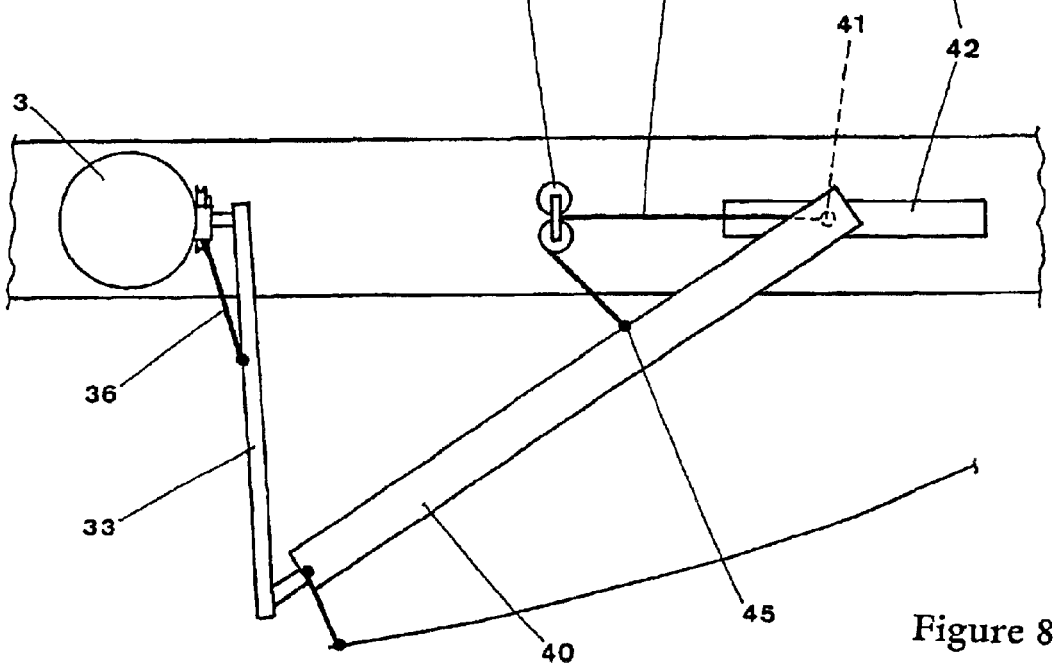
FIG. 8: illustrates a plan view of FIG. 7.

Referring now to FIGS. 7 and 8, a third sail tacking arrangement on the mast hull 2, according to an alternative aspect of the invention, is illustrated.

A reduction in the radius of curvature can also be achieved by the following arrangement. The top end of the boom 33 is pivotably attached to a sliding member 34 slidable within a vertically disposed guiding slide mechanism 35 on the mast 3. A rope 36 is attached at one end to the slide mechanism 35 and passes through a block in the form of a pulley 37 on the mast 3 and the other end of the rope 36 is fixedly attached to a suitable point 38 on the boom 33. The lower end of the boom 33 is attached to the jib 14 with a link 39 as in the previously mentioned arrangements. The lower end of the boom 33 is also attached to the aft end of a boom 40. Preferably the booms 33, 40 are made of carbon fibre.

The fore end of the boom 40 is pivotably attached to a sliding member 41 slidably associated within a horizontally disposed guiding slide mechanism 42 on the boom 12. A rope 43 is attached to the sliding member and passes through a block in the form of a pulley 44 mounted on the boom 12 and the other end of the rope 43 is fixedly attached to a suitable point 45 on the boom 40. This arrangement will have the effect that when the booms 33, 40 are out at an angle to the wind, the booms 33, 40 are pulled toward the dew 18, tightening the jib 14.

It is considered that the forestay will be free to pivot about its top mounting and can slide on the slide mechanism 42 at its lower mounting. This can allow the balancing force of the jib 14 to be on a varying moment arm while still retaining a substantially high efficiency along with a substantially high efficiency of the mailsail 13. Therefore, the distance of the jib 14 along the sliding mechanism 42 allows the boom 12 to be balanced at any desired angle of attack to the wind.

Figure 9:
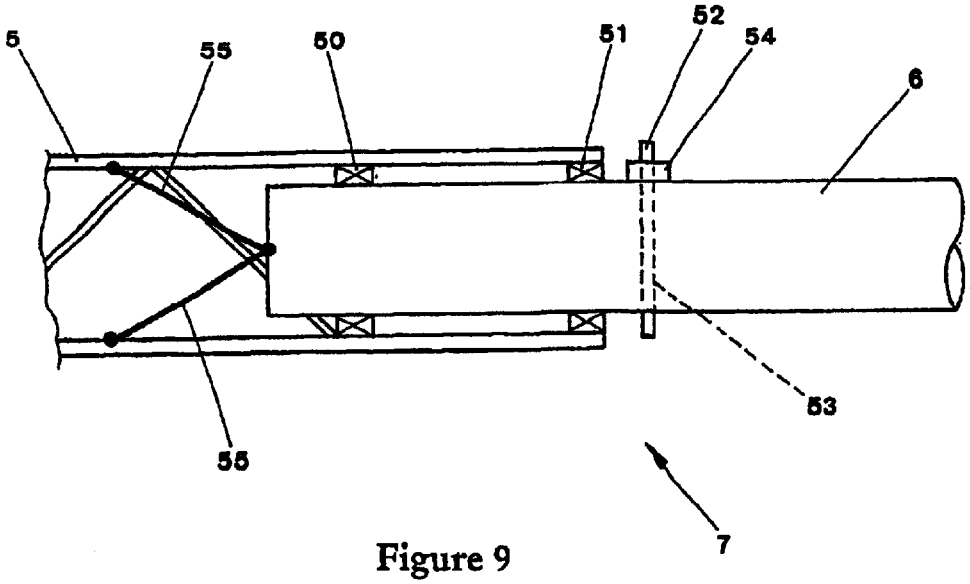
FIG. 9: illustrates a side view of a beam joint.

Referring to FIG. 9, a side view of a centrally positioned beam joint means, according to a preferred embodiment of the invention, is illustrated.

The beam 5 is laterally slidably associated with the beam 6 by way of a suitable arrangement of bearings about the joint 7. The beam 6 is desirably tubular to enable the beam 6 to be rotatably connected or attached to the beam 5 by bearing means in the form of ring bearings 50, 51. Desirably the bearings 50, 1 are sealed as for other bearings used in the design of the multihull boat 1. The bearings 50, 51 are attached to the beam 5 by any known and suitable attachment means and may include being welded to the beam 5. The beam 6 can rotate to allow the hull 8 to pitch independently of the hull 2. Also the beam 6 is advantageously free to laterally slide through the central core of the bearings 50, 51 when the hulls 2, 8 are required to be substantially parallel to and adjacent the other during transportation or when being moored in a marina berth for a monohull boat.

A releasably attachable securing means in the form of a pin 52 is provided to set and retain the desired distance between the hulls 2, 8. The pin 52 is located on the outside of the bearing 51 and is located through an aperture 53 in the tube 6. The pin 52 also passes through a bearing block 54. The bearing block 54 can rub on the bearing edge of the bearing 51 without unduly wearing of the joint 7. Additionally, the securing means includes a securing line 55 attached at a mid point to the end of the tube 6 prevents the tube 6 from sliding out from the joint 7. The line 55 may be releasably attachable.

Figure 10:
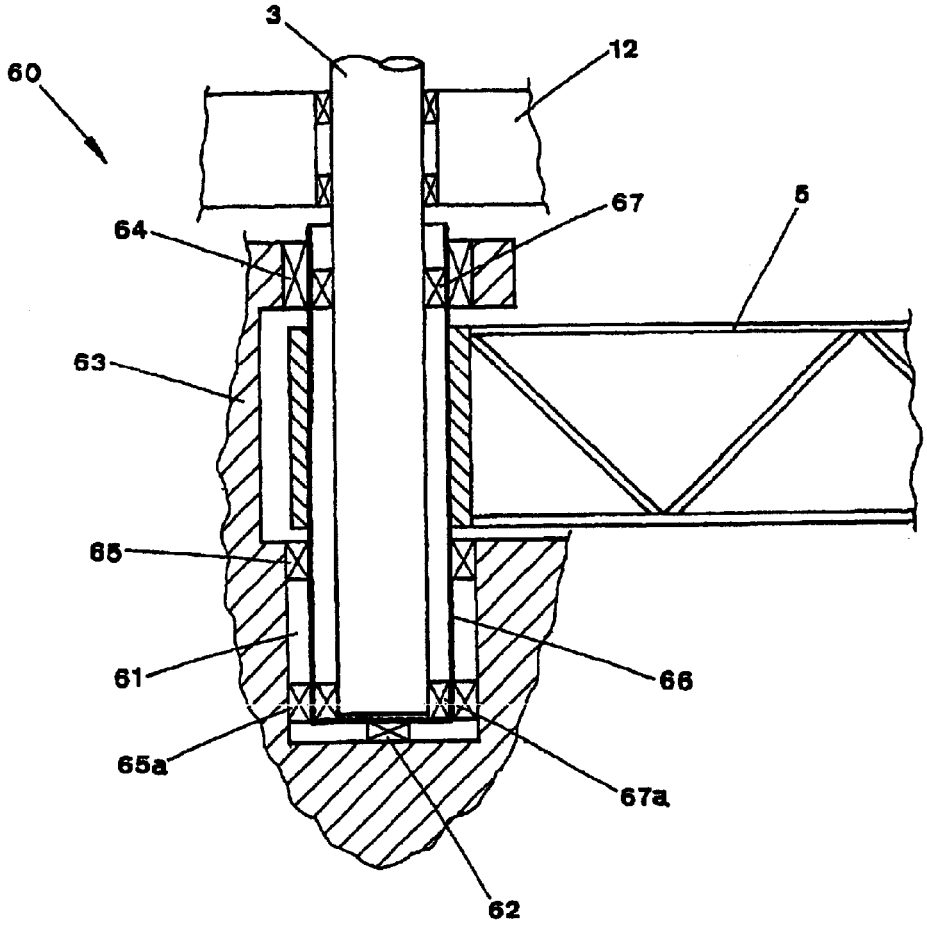
FIG. 10: illustrates a side view of the beam to mast hull joint.
Figure 11:
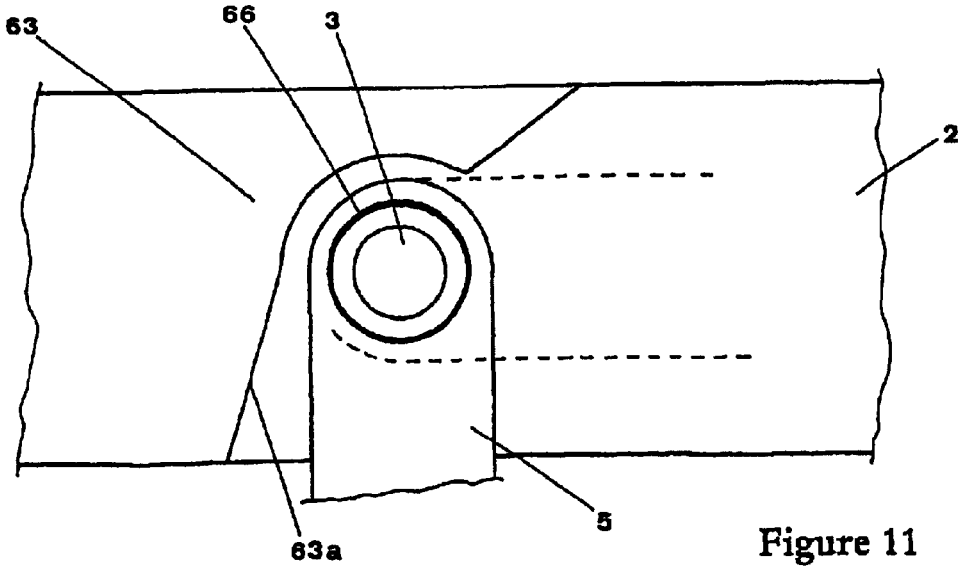
FIG. 11: illustrates a plan view of the beam to mast hull joint.

Referring now to FIGS. 10 and 11, a beam to mast hull joint, generally referred to as 60, is illustrated.

The beam to mast joint 60 on the mast hull 2 is preferably arranged to allow for free vertical rotational movement of the mast 3. In this arrangement the mast 3 is set in a cylindrical mounting cavity 61. A thrust bearing 62 is adapted to assist the retention of the mast 3 within the cavity 61.

The hull 2 can be suitably moulded to form a mast support section or raised hull section 63 to support the mast 3 above the mounting position of the beam 5. The hull 2 is desirably formed and moulded with modern fibre composites such as, for example, fibreglass and a foam core. The hull 2 is adapted to retain suitable bearings 64, 65, 65*a* to facilitate easy vertical rotation of the beam 5.

Advantageously the bottom end of the mast 3 is set adjacent a cylindrical tube or sleeve 66 that fits into the cavity 61. The sleeve 66 advantageously extends vertically to a position slightly above the bearings 64. The beam 5 is rotatably associated with the mast 3 by being bonded to the sleeve 66. The sleeve 66 is desirably provided with bearings 67, 67*a* to facilitate the vertical rotation of the beam 5 relative to the mast 3.

Referring more particularly to FIG. 11, the preferred shape of the raised hull section 63 of the hull 2 is seen more dearly. A consideration with the bearing edge 63*a* is to allow the distal end of the beam 5 to rotate up to 90 degrees for transportation purposes or otherwise. With the sliding beam arrangement as described with reference to FIG. 9, the securing line 55 can be released, allowing beam 6 to be removed before rotating the beam 5 toward the bow of the hull 2. A folding beam means forms an alternative arrangement and is described below with reference to FIGS. 13 to 15.

Figure 12:
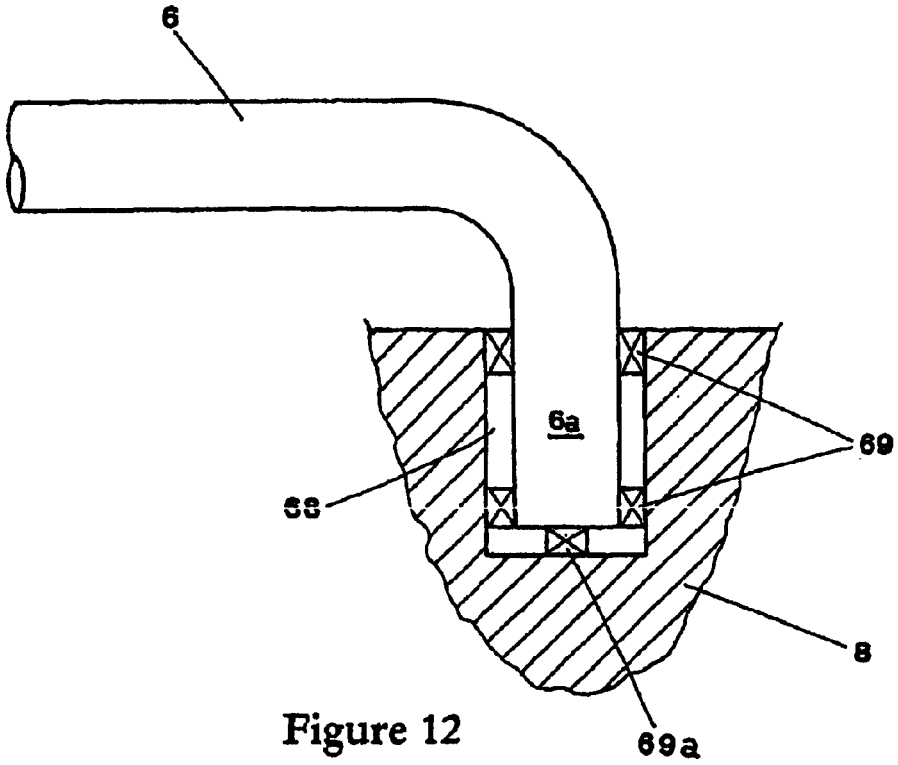
FIG. 12: illustrates a side view of the beam to non-mast hull joint.

Referring to FIG. 12, a side view of the beam to non-mast hull joint, is illustrated.

The tube 6 is desirably bent substantially 90 degrees such that the tube end section 6*a* is set in a cavity 68 in the hull 8. Bearings 69 are set between the tube 6 and the wall of the cavity 68. The tube 8 is desirably retained in the cavity 68 by a thrust bearing 69*a* that also assists with the substantially vertical rotation of the tube end section 6*a*.

Figure 14:
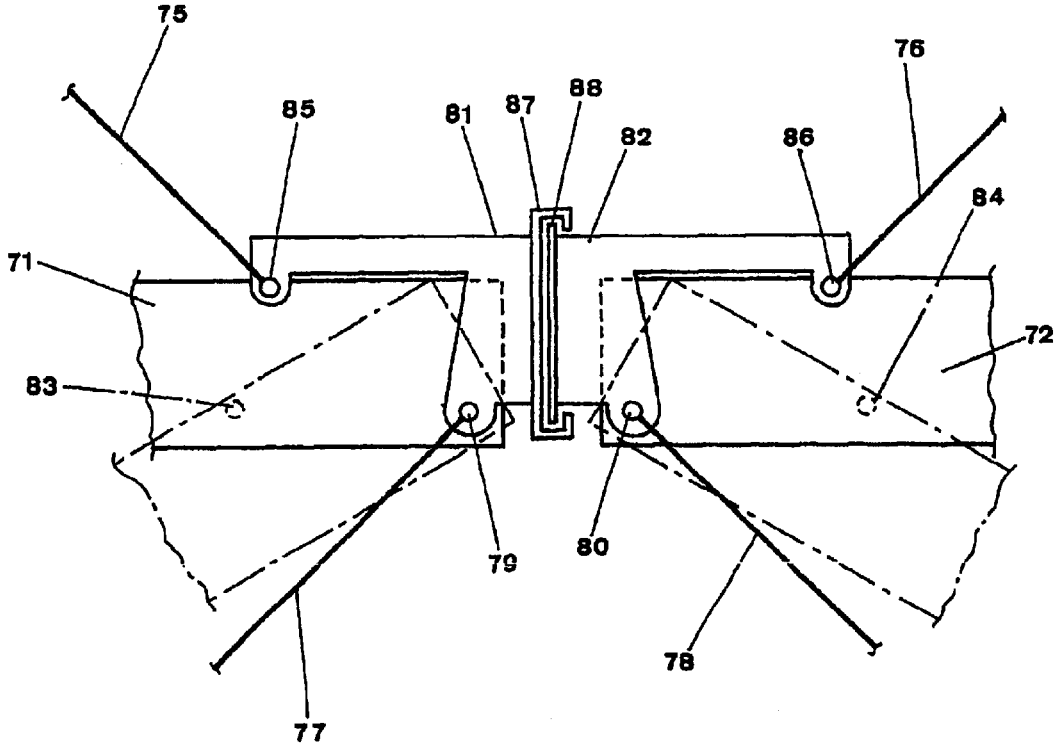
FIG. 14: illustrates a detailed plan view of the beam joint connecting the beams of FIG. 13.
Figure 13:
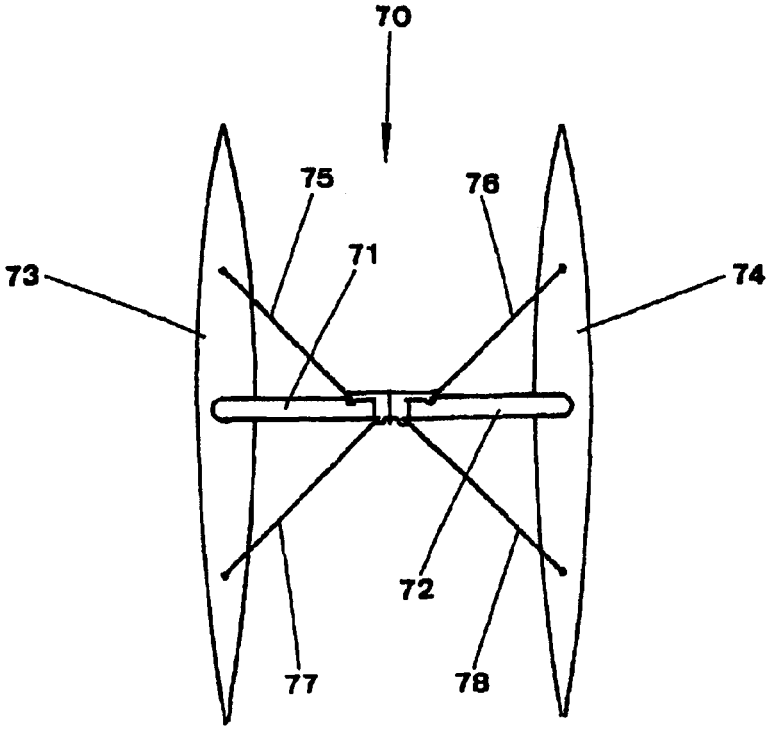
FIG. 13: illustrates a plan view of a foldable beam means according to an alternative embodiment of the invention.

Referring now to FIGS. 13 and 14, a foldable beam means, generally referred to as 70, in accordance with an alternative embodiment of the invention, is illustrated.

It is considered desirable to design a multihull watercraft with a folding beam means 70 that can be fixed in an extended position during use of the multihull boat 1 as shown broadly in FIG. 13, or partially or completely folded for convenience or spacesaving purposes or otherwise. A folding beam means 70 can advantageously allow the multihulls to be drawn together for more compact transportation and for mooring in marina berths designed for monohulls.

A foldable beam means 70 includes beams 71, 72 pivotally attached to respective hulls 73, 74. The pivotable arrangements of the beams 71, 72 as attached to respective hulls are similar to those hulls 2, 8 as described with reference to FIGS. 10 to 12 and will not be repeated.

Additionally, hull stabiliser means in the form of stays (ropes) or struts 75, 76, 77, 78 are connected between the hulls 73, 74 and the beam means, and in this embodiment are connected between the hulls 73, 74 and the pivot joints 85, 86, 79, 80 of the central brackets 81, 82. Alternatively the struts 75, 76, 77, 78 can be attached at a suitable position on the beams 71, 72 or a combination of beams 71, 72 and any one or more of the pivot joints 85, 86, 79, 80. Advantageously, the struts 77, 78 are releasably attachable to respective hulls 73, 74 at attachment points 79, 80. It will be appreciated that the stays may be flexible and the struts rigid. The struts may be telescoped in design.

When folding the beam means as required, the struts 75 to 78 can be released from the attachment points 85, 86, 79, 80 respectively, or from the attachment points on the hulls 73, 74. Alternatively, and as appreciated by those skilled in the art, the struts may be folded, bent, extended and/or shortened as required by any known means, including using pulleys, winches in association with hydraulic, electrical or mechanical means (not shown). If rigid struts are used, then it is preferable to have either struts 75, 76 or struts 77, 78 rigid.

It is considered an advantage to have struts 75 to 78, either as flexible or rigid struts or stay wires or ropes, not just as a means to assist in stabilising the beams 71, 72 but also to strengthen the arrangement, particularly with absorbing wave shocks and other forces applied, during use, to the beam means and multihull boat. It is envisaged that the beams 71, 72 and the struts 75 to 78 may be provided with longitudinal spring means for additional flexing ability.

As seen more clearly in FIG. 14, the beams 71, 72, desirably tubular in cross section, are attached at respective pivot joints 79, 80 to respective central brackets 81, 82. Suitably located apertures 83, 84 on respective beams 71, 72 align with respective brackets 81, 82 when the beams 71, 72 are in a fully extended position. Latching pins (not shown) will lock or retain the respective beams 71, 72 in position through mounting lugs 85, 86 during use of the multihull boat. Desirably the strut 75 is attached to the lug 85 and the strut 76 is attached to the lug 86.

The central brackets 81, 82 are preferably rotatably associated by way of a bearing housing 87. The bearing housing 67 allows inner bearing disc 88 at the end of the tubular beam 82 to rotate within the housing 87. The outer housing is at the end of the beam 71. It will be appreciated that this bearing housing 87 will allow the hulls 73, 74 to pitch independently during use of the multihull boat. In operation, when the beams 71, 72 are folded, spacer members (not shown) can be positioned across the hulls 73, 74 to fix the preferred shortened distance between the hulls 73, 74.

Figure 15:
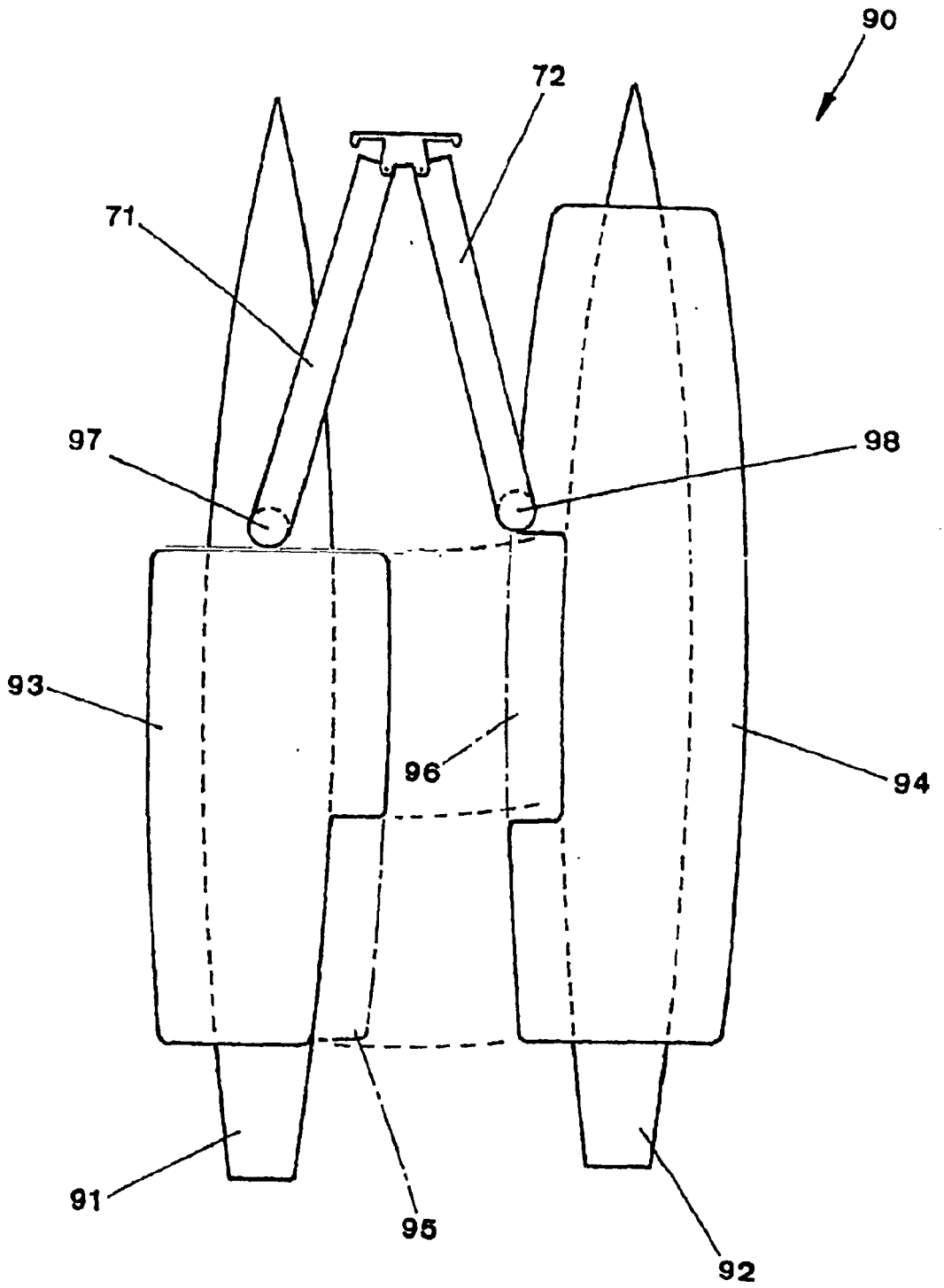
FIG. 15: illustrates a plan view of a multihull boat with a partially folded beam and interfitting hull arrangement.

Referring to FIG. 15, a plan view of a multihull boat with a partially folded beam and interfitting hull arrangement, is illustrated.

The multihull boat 90 includes hulls 91, 92 having cabins or berths 93, 94 configured and arranged to follow a contour to enable the cabins, when interfitted, to nest together when the beams 71, 72 are fully folded. Advantageously, this arrangement allows one or both hulls 91, 92 to be wider at some part of their length than would otherwise be possible where there is a maximum width limit of the folded boat 90 such as, for example, when on a trailer or in a marina berth. This allows the berths 93, 94 to be advantageously arranged for maximum privacy and convenience.

Desirably the boat 90 includes releasable attachable members 95, 96 preferably in the form of foldable or flexible seating or walkways respectively. It is seen that these areas can be used during water movement of the boat, and when folding and nesting is required, the members 95, 96 can be folded or removed.

The pivot points 97, 98 of the folding beams 71, 72 are seen to be attached to different points on the hulls 91, 92. The pivot point 97 of the beam 71 is pivotably connected to the centre of the hull 91 and the pivot point of the beam 72 is pivotably connected to the edge of the cabin or berth 94. The offset pivot points 97, 98 are considered desirable in some application as it can allow for the beams 71, 72 to fold from an extended position to a folded position in a desirably manner to facilitate close inter fitting of the hulls 91, 92.

It is considered an advantage to have interfitting hulls, as it is envisaged that with larger forms of the multihull boat 90, it may allow sufficient top surface area for a helipad by narrowing the corresponding length of the other hull without unduly limiting the width of that hull in other parts of its length (not shown). Alternatively the helipad may simply be a large area on one of the hulls.

It will be appreciated that a multihull boat can include a variety of forms of hulls and configurations within the scope of the invention. A hull may be unpowered with no form of power source such as, for example, a barge or outrigger; or be engine powered; or be sail powered; or be any combination of the various forms of hulls. With each type of hull the pivotally attached beam means may be permanently mounted between hulls with a sliding beam arrangement, or include a folding beam means. Either beam means arrangement is either releasably attachable to either or all the hulls depending on whether the multihull boat is desired to be used with all hulls or not. It is considered that the configuration of a releasably attachable non-powered hull can be suitable as a cargo vessel, particularly with low density loads.

It is preferably that marine materials such as, for example, carbon or glass fibre, stainless steel, kevlar or combinations thereof be used. Fibre composite materials are preferred in the marine environment as they are non-corrosive and have a high strength to weight ratio.

It will be appreciated that the circular bearing units used in the embodiments and various aspects of the invention may include ball or roller bearings, and it is envisaged that any known type of suitable bearing may be used, particularly sealed bearing units designed for the marine environment.

Wherein the aforegoing reference has been made to integers or components having known equivalents, then such equivalents are herein incorporated as if individually set forth. Accordingly, it will be appreciated that changes may be made to the above described embodiments of the invention without departing from the principles taught herein. Additional advantages of the present invention will become apparent for those skilled in the art after considering the principles in particular form as discussed and illustrated. Thus, it will be understood that the invention is not limited to the particular embodiments described or illustrated, but is intended to cover all alterations or modifications which are within the scope of the appended claims.

What is claimed is:

1. An apparatus for attachment to a multihull boat, the apparatus including a beam means substantially transversely associated with at least a first hull and a second hull, the first hull and the second hull being substantially laterally opposed and each hull having a longitudinal axis in the direction of travel of the boat, the beam means being pivotably connected to a first hull to allow for horizontal rotational movement of the first hull, the beam means being pivotably connected to a second hull to allow for horizontal rotational movement of the second hull, and wherein the beam means is adapted to enable the first hull and the second hull to pitch independently of the other, and including a means for folding the beam means between a first extended position with the first hull and the second hull in a spaced apart orientation and a second folded position with the first hull and the second hull in a side by side orientation.

2. An apparatus according to claim 1 wherein the beam means includes a first beam pivotably connected to the first hull and a second beam pivotably connected to the second hull, and wherein a beam joint means is positioned between the first hull and the second hull such that the first hull and the second hull pitch independently of the other.

3. An apparatus according to claim 2 wherein the beam joint means includes a releasably attachable securing means retaining the first beam and the second beam in pivotable association in the second folded extended position, or the first extended position.

4. An apparatus according to claim 2 wherein the first beam and the second beam are pivotably connected to a rotational housing located in a suitable position along the beam means.

5. An apparatus according to claim 4 wherein the rotational housing is a bearing housing, and the location of the housing is substantially adjacent a central position between the first hull and the second hull.

6. An apparatus according to claim 1 wherein the first hull and the second hull are adapted to interfit in a nesting arrangement when the first hull and the second hull are brought together in the second folded position of the first beam and the second beam.

7. An apparatus according to claim 1 wherein the first hull is provided with a mast that is pivotably connected to the hull to allow for vertical rotational movement of the mast, and wherein the beam means is pivotably connected to the mast to enable vertical rotational movement of the beam means.

8. An apparatus according to claim 7 wherein the first hull is adapted to form a mast support section, the mast support section being associated with the mast above the pivot connection of the first beam to the mast.

9. An apparatus according to claim 7 wherein the mast is tubular and pivotably connected to a cylindrically shaped cavity in the first hull, and wherein a tubular sleeve is fitted between the mast and the cavity and adapted with bearing means to increase the free substantially vertical rotational movement of the mast and the first beam.

10. An apparatus according to claim 9 wherein the sleeve and the first beam are permanently attached.

11. An apparatus according to claim 1 wherein the beam means is adapted to enable the hulls to rotate 360 degrees with respect to each other in either or both substantially horizontal or vertical rotations.

12. An apparatus according to claim 1 wherein hull stabilising means are provided between the beam means and the first hull and the second hull, the stabilising means being four flexible stays or rigid struts, or a combination thereof, each said stay or strut being connected at one end to the beam means and the other end being connected to either fore or aft of the first hull or the second hull.

13. An apparatus according to claim 1 wherein hull stabilising means are provided between the beam means and the first hull and the second hull, the stabilising means being at least two rigid struts, each said strut being connected at one end to the beam means and the other end of at least one strut being connected to either fore or aft of the first hull and at least one strut being connected to either fore or aft of the second strut.

14. An apparatus according to claim 12 wherein at least two of the stays or struts are releasably attachable to either the first hull or the second hull or the beam means.

15. An apparatus according to claim 1 wherein the pivotable connections of the beam means to the first hull and the second hull are provided with bearings.

* * * * *